United States Patent [19]

Cunningham

[11] Patent Number: 4,688,479

[45] Date of Patent: Aug. 25, 1987

[54] TEA BAG HOLDING DEVICE

[76] Inventor: Jeffrey E. Cunningham, 1187 Princeton, Bartlett, Ill. 60103

[21] Appl. No.: 816,446

[22] Filed: Jan. 6, 1986

[51] Int. Cl.[4] ..... B30B 9/02

[52] U.S. Cl. ..... 100/133; 99/323; 220/DIG. 5; 426/80

[58] Field of Search ..... 99/323, 317, 318, 319, 99/321, 322, 287; 100/123, 234, 132, 133; 15/260, 261, 262, 263; 220/DIG. 5, DIG. 6; 215/100.5; 426/80, 77, 82

[56] References Cited

U.S. PATENT DOCUMENTS

| | | | |
|---|---|---|---|
| 1,432,754 | 10/1922 | Hollowell | 100/132 |
| 1,835,966 | 12/1931 | Pochyla | 100/133 |
| 3,027,826 | 4/1962 | Morris | 100/133 |
| 3,126,821 | 3/1964 | Schlidt | 100/133 |
| 3,244,089 | 4/1966 | Wilson | 100/133 |
| 3,632,015 | 1/1972 | Barth | 215/100.5 |

*Primary Examiner*—Robert W. Jenkins
*Attorney, Agent, or Firm*—Douglas B. White

[57] ABSTRACT

There is provided a tea bag holding device comprising a base having defined therein a receptacle for collecting drips from the tea bag and opposing squeeze members hingedly affixed to the receptacle and protruding up therefrom for use in holding the tea bag during brewing and for squeezing the tea bag upon completion of the brewing.

8 Claims, 5 Drawing Figures

TEA BAG HOLDING DEVICE

BACKGROUND OF THE INVENTION

The present invention relates to enclosures for tea bags during brewing and more particularly to devices for handling tea bags following brewing.

Generally, devices have existed in the prior art for enclosing a tea bag or tea leaves during brewing, but no device has been developed for holding a tea bag during brewing and providing means for squeezing and handling the tea bag upon completion of the brewing. Moreover, no device has been presented which may be economically molded as one piece when made out of plastic and therefore economically manufactured.

SUMMARY OF THE INVENTION

Generally there is provided a tea bag holding device comprising a base having defined therein a receptacle for collecting drips from the tea bag and opposing squeeze members hingedly affixed to the receptacle and protruding up therefrom for use in holding the tea bag during brewing and for squeezing the tea bag upon completion of the brewing. Protruding from one of the squeeze members is a hook device for suspending the tea bag holder from the rim of the cup.

Other objects and advantages of the invention will become apparent upon reading the following detailed description and upon reference to the drawings.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
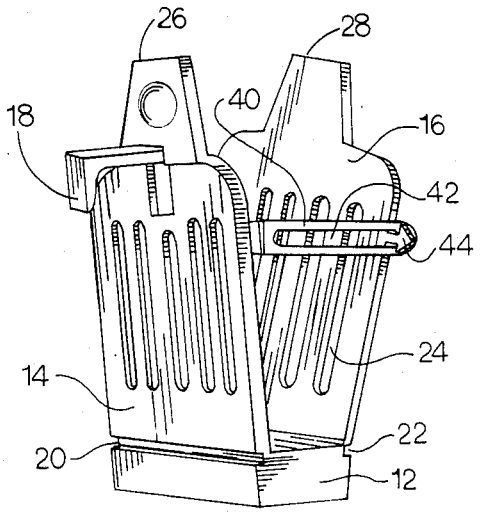
FIG. 1 is a perspective view of the tea bag holding device of the present invention.

Turning to FIG. 1, there is shown generally the tea bag holding device of the present invention comprising a base 12 and dual squeeze members 14 and 16. The tea bag holding device is arranged to be suspended from the rim of a cup by a hook device 18 affixed to the upper portion of one squeeze member 14.

These squeeze members are affixed to the base 12 by hinges 20 and 22 comprising indentations arranged to form thin walls at the top edge of the base 12. Accordingly, due to the thinner wall at this location, pressure applied to the squeeze members will cause bending to occur along the indentations. The squeeze members are provided with slots 24 to allow liquid to flow past the tea bag for improved brewing operation. Finger operation of the tea bag squeezing function is accomplished by providing protruding tabs 26 and 28 at the topmost portion of the squeeze members.

Figure 3:
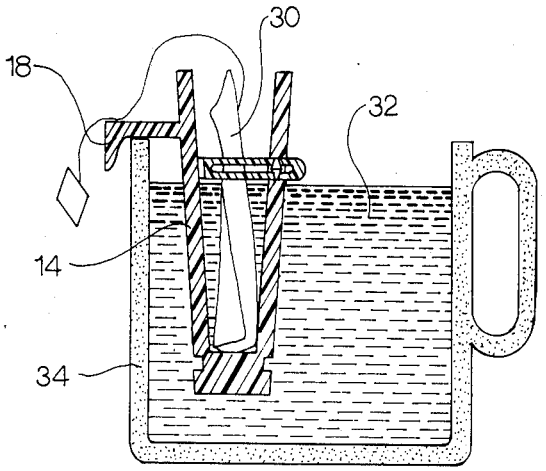
FIG. 3 is a side view of the tea bag holding device of FIG. 1 shown suspended on the rim of a cup during brewing.

During brewing (FIG. 3) a tea bag 30 is inserted within the tea bag holding device and suspended in the hot water 32. The hook device 18 affixed to one squeeze member 14 protrudes over the edge of the cup 34 to position the tea bag holding device within the hot liquid. Upon completion of the brewing process, the tea bag holding device is grasped by the upper tabs 26 and 28 on the squeeze members and removed from the liquid, concurrently squeezing the tea bag by the application of force against the tab members. In the preferred operation, the device is also tilted to empty any liquid trapped within the receptacle area, more fully described below, whereupon the tea bag holding device may be placed upon a flat surface where it maintains a balanced, upright position sitting upon its receptacle base 12.

Figure 2:
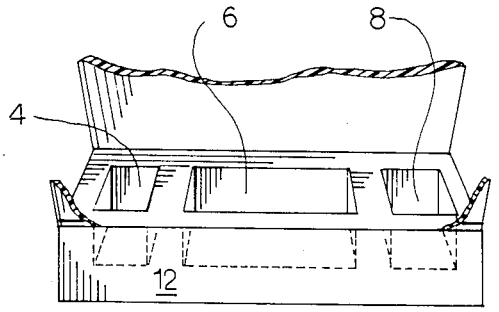
FIG. 2 is a partially cut-away side view of FIG. 1 showing the drip collecting receptacle.

The base 12 (FIG. 2) has located therein drip collecting troughs 4, 6, and 8 positioned to receive any residual drips which may emanate from the tea bag following the squeezing operation. After being previously emptied during the squeezing operation, the troughs are in condition to receive a substantial quantity of drip while the device sits following the brewing operation.

Figure 4:
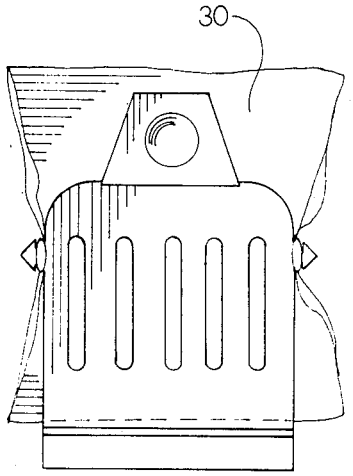
FIG. 4 is a side view of the tea bag holding device of FIG. 1 showing the additional side contact of the tea bag holding device against the tea bag.

In a further aspect of the present invention, there are provided side members 40 hingedly affixed to both vertical sides of one squeeze member 14 and arranged to protrude toward the opposing squeeze member 16. Within each side member there is provided a longitudinal slot 42 arranged to slidably receive the catch member 44 affixed to the opposing squeeze member 16. Due to the slidable motion, the squeeze members may be reciprocated one towards the other, allowing the catch protrusion 44 to reciprocate within slot 42 and thereby at all times retaining the tea bag 30 placed therebetween (FIG. 4).

The catch protrusion 44 is characterized by an expanded head at its extremity and is positioned through the elongated slot 42 by forcing the slot to expand to allow the head to slide through. Once through, the slot recloses to its normal dimensions. Accordingly, the slot cannot be pulled past the expanded head and, once assembled, the tea bag holding device will securely hold its assembly.

Figure 5:
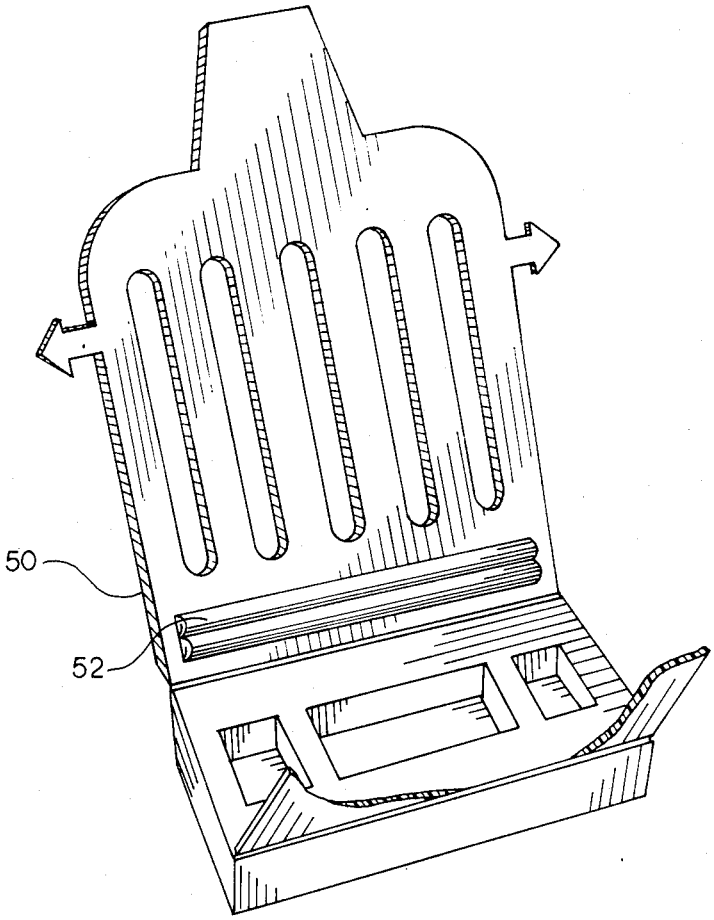

In a further embodiment of the present invention shown in FIG. 5 there is provided additional means for enhancing the squeezing effect of the device. There is provided on each squeezing member 50 a plurality of ridges 52 protruding from the squeezing member and arranged to squeeze against the tea bag during operation. This feature provides increased squeezing pressure against the tea bag for more efficient operation.

It can be seen from the above that this tea bag holding device is designed to be manufactured in a customary one-sided plastics mold and yields a device which may be assembled into a three-dimensional, operational device. Generally there has been shown and described an improved tea bag holding device having tea bag holding, brewing, and squeezing capabilities, but further having the capability to be self-supporting with means for collecting drips from the tea bag.

I claim:

1. A tea bag holding device comprising:

a base member for supporting the device and the tea bag in an upright freestanding position; and first and second plate members affixed to said base by hinge means and arranged to receive a tea bag therebetween, wherein said hinge means is comprised of a reduced plate thickness at the point of attachment to said base, such that said base and plate members are all formed of one piece.

2. The device of claim 1 wherein said base member has defined therein a drip collecting receptacle.

3. The device of claim 2 further comprising first and second slidable side support members affixed to said first plate member and arranged to span the gap to slidably engage said second plate member, whereby said plate members are allowed to pivot at their respective hinges while said support members remain engaged.

4. The device of claim 3 wherein said side support members are affixed to said first plate member by hinge means, wherein said hinge means is comprised of a reduced thickness at the point of attachment to said plate such that said side support members, base, and plate members are all formed of one piece.

5. The device of claim 4 further comprising ridge members transversely disposed across said side support members for providing increased squeezing pressure against the tea bag.

6. A tea bag holding device comprising:

(a) a base member having defined therein a drip collecting receptacle;

(b) first and second plate members affixed to said base by hinge means, and arranged to receive a tea bag therebetween; and (c) first and second side support members hingedly affixed to said first plate member and arranged to span the gap and engage said second plate member;

(d) wherein said second plate member has protrusions defined on opposing edges thereof and wherein said side support members have elongated openings defined therein and arranged to receive said protrusions.

7. The device of claim 6 further comprising hook means affixed to said first plate member for suspending said device therefrom.

8. The device of claim 6 further comprising ridge members transversely disposed across said side support members for providing increased squeezing pressure against the tea bag.

* * * * *